US008925285B2

(12) United States Patent
Brewerton

(10) Patent No.: US 8,925,285 B2
(45) Date of Patent: Jan. 6, 2015

(54) PRESSURE RESISTING BARRIER WALLS

(75) Inventor: Robert Walter Brewerton, Kent (GB)

(73) Assignee: Inoventech Limited, Highams Park (GB)

( * ) Notice: Subject to any disclaimer, the term of this patent is extended or adjusted under 35 U.S.C. 154(b) by 0 days.

(21) Appl. No.: 13/884,335

(22) PCT Filed: Nov. 10, 2011

(86) PCT No.: PCT/EP2011/069846

§ 371 (c)(1),
(2), (4) Date: Jul. 23, 2013

(87) PCT Pub. No.: WO2012/062859

PCT Pub. Date: May 18, 2012

(65) Prior Publication Data

US 2013/0340370 A1 Dec. 26, 2013

(30) Foreign Application Priority Data

Nov. 11, 2010 (GB) ..... 1019070.0

(51) Int. Cl.

| | |
|---|---|
| ***E04C 2/32*** | (2006.01) |
| ***E02D 5/04*** | (2006.01) |
| ***E04B 1/94*** | (2006.01) |
| ***E04B 1/98*** | (2006.01) |
| ***E04H 9/00*** | (2006.01) |

(52) U.S. Cl.

CPC .. *E04H 9/00* (2013.01); *E02D 5/04* (2013.01); *E04B 1/94* (2013.01); *E04B 1/98* (2013.01)

USPC ..... 52/783.13

(58) Field of Classification Search

CPC ... E04C 2002/3455; E04C 2/08; E04C 2/322; E04B 1/94

USPC ..... 52/167.1, 1, 783.11, 783.12, 783.13, 52/783.14, 783.15, 783.16, 783.17, 52/783.18, 783.19

See application file for complete search history.

(56) References Cited

U.S. PATENT DOCUMENTS 3,388,516 A * 6/1968 Thielen ..... 52/393
3,807,106 A 4/1974 Reinhardt et al.

(Continued)

FOREIGN PATENT DOCUMENTS

| | | |
|---|---|---|
| DE | 76 26 228 U1 | 12/1976 |
| EP | 2105549 | 9/2009 |
| GB | 2278376 | 11/1994 |
| GB | 2315288 | 1/1998 |
| GB | 2 327 098 A | 1/1999 |

(Continued)

OTHER PUBLICATIONS

International Search Report prepared by the European Patent Office on Feb. 2, 2012, for International Application No. PCT/EP2011/069846.

(Continued)

*Primary Examiner* — William Gilbert
*Assistant Examiner* — Gisele Ford
(74) *Attorney, Agent, or Firm* — Sheridan Ross P.C.

(57) ABSTRACT

A pressure resisting barrier wall resistant to accidental explosions and fires or hydrostatic pressure comprising a corrugated wall member (100) having a series of side by side corrugation which viewed in transverse section each comprise spaced first and second base portions (102, 102') by a polygonal arch having at least three sides (106, 106', 108, 108') within said archacurved or polygonal arch reinforcement wall (124, 124', 124", 125) springing from side portions of said polygonal arch.

13 Claims, 3 Drawing Sheets

(56) References Cited

U.S. PATENT DOCUMENTS

| | | | | |
|---|---|---|---|---|
| 4,014,148 | A | 3/1977 | Harter | |
| 4,034,135 | A * | 7/1977 | Passmore | 428/184 |
| 4,530,197 | A * | 7/1985 | Rainville | 52/783.15 |
| 5,199,240 | A * | 4/1993 | Ewald, Jr. | 52/798.1 |
| 6,270,915 | B1 * | 8/2001 | Turpin et al. | 428/703 |
| 6,415,581 | B1 * | 7/2002 | Shipman et al. | 52/798.1 |
| 6,691,482 | B1 * | 2/2004 | Ault | 52/450 |
| 7,051,489 | B1 * | 5/2006 | Swiszcz et al. | 52/783.18 |
| 7,207,151 | B2 * | 4/2007 | Swiszcz et al. | 52/793.11 |
| 7,861,480 | B2 * | 1/2011 | Wendelburg et al. | 52/483.1 |
| 7,987,647 | B2 * | 8/2011 | Rymell et al. | 52/506.06 |
| 2007/0044411 | A1 | 3/2007 | Meredith et al. | |
| 2013/0269264 | A1 | 10/2013 | Brewerton | |

FOREIGN PATENT DOCUMENTS

| | | |
|---|---|---|
| WO | WO 89/11007 | 11/1989 |
| WO | WO 2011/084071 | 7/2011 |

OTHER PUBLICATIONS

International Search Report prepared by the European Patent Office on Aug. 8, 2011, for International Application No. PCT/EP2011/057807.

Official Action for U.S. Appl. No. 13/697,431 mailed Aug. 27, 2013, 10 pages.

Notice of Allowance for U.S. Appl. No. 13/697,431 mailed Dec. 23, 2013, 7 pages.

* cited by examiner

PRESSURE RESISTING BARRIER WALLS

CROSS-REFERENCE TO RELATED APPLICATIONS

This application is a national stage application under 35 U.S.C. 371 and claims the benefit of PCT Application No. PCT/EP2011/069846 having an international filing date of 10 Nov. 2011, which designated the United States, and which PCT application claimed the benefit of Great Britain Application No. 1019070.0 filed Nov. 11, 2010, the disclosure of which is incorporated herein by reference.

Pressure is resisted principally by a bending action where the bending stresses are approximately parallel to the corrugations. Such barriers are used as walls for a variety of functions such as resistance to accidental explosions and fires (blast resisting walls) or hydrostatic pressure, for example in tanks containing liquids. They are used in earth retaining structures, in decking to resist loads imposed from above or below and in bulkheads in ferries and other ships.

GB2327098 describes various configurations of such walls.

Such walls may be formed from corrugated sheeting with polygonal arched (e.g. trapezoidal three sided flat topped) corrugations or four sided polygonal corrugations with a pointed top. The corrugations may be formed by pressing a sequence of bend lines into a flat plate and then welding or otherwise joining the edges of the corrugated plates together to make a continuous barrier.

Maximum economy usually comes from making the plate material of the corrugated sheeting as thin as possible for the span and loading. To achieve this, the depth 'd' of the corrugations must be large in relation to the plate thickness 't'. With corrugated barriers which have a large d/t ratio, load capacity is limited by the out-of-plane bending strength and deflection of the plate panels or by buckling due to longitudinal bending stresses in the plane of the plate panels. Both are a function of the b/t ratio of the plate panels and to ensure that the section is effectively utilised the d/t ratio must be limited. In this expression b is the width of a panel between supported edges and t is its thickness It may be noted that when such a barrier wall is subjected to pressure from the 'outside', i.e. against the apices of the corrugations, it bows inwards towards the 'inside', i.e. the space behind the other face of the wall. This causes the outer part of the wall to be in compression and the inner part of the wall to be in tension and these two zones are separated by a 'neutral axis' where the material of the wall is neither compressed nor put under tension and so is stress free and is not resisting deflection of the wall. The 'neutral axis' may initially be a plane but upon bending is a curved, imaginary surface, the position of which may change as the wall bends.

In GB2327098 polygonal arches forming corrugations were internally reinforced by transverse bridging plates or by corner bridging plates. We have now appreciated that a transverse flat plate bridging between sides of the polygonal arch does not contribute to the maximum to resisting bending forces.

Accordingly, the present invention provides a pressure resisting barrier wall comprising a corrugated wall member having a series of side by side corrugations which viewed in transverse section each comprise spaced first and second base portions connected by a polygonal arch having at least three sides, and having within said arch a curved or polygonal arch reinforcement wall springing from side portions of said polygonal arch, the second base portion of a said corrugation being joined to the first base portion of a next corrugation in said series.

Preferably, the centre of area of the reinforcement wall lies on the compression side of the neutral axis of the wall, load being envisaged to be applied to the convexities of the corrugations.

Optionally, said reinforcement wall connects to the polygonal arch at a level which lies on the compression side of the neutral axis. Thus, the whole of the reinforcement wall lies on the compression side of the neutral axis.

However, in some embodiments it is arranged that the centre of area of the reinforcement wall lies on the tension side of the neutral axis of the wall, load being envisaged to be applied to the convexities of the corrugations, or even that the whole of the reinforcement wall lies on the tension side of the neutral axis.

Preferably, said polygonal arch is a four sided arch or a three sided arch and most preferably, said reinforcement wall is a two sided polygonal arch. However, the arch may be continuously curved, e.g. part circular in cross section.

The base of each corrugation may comprise a flange which is overlapped with a corresponding flange of the base of an adjacent corrugation, e.g. by at least 60% of the flange width, and is fixed thereto.

The ratio of the depth of each polygonal arch to its breadth is suitably from 1:1.25 to 1:4.

Optionally, said first and second base portions are so angled that the joining of the second base portion of a said corrugation to the first base portion of a next corrugation in said series produces a further and oppositely directed polygonal arch.

Optionally, junctions between the sides of a reinforcement wall which is directed towards the compression side of the pressure resisting barrier wall and its respective polygonal arch are so disposed with respect to junctions between sides of an adjacent reinforcement wall directed towards the tension side of the pressure resisting barrier wall and the spaced polygonal arches of adjacent corrugations that to pass from one side of the pressure resisting barrier wall to the opposite side thereof involves passing through at least two thicknesses of wall material.

Reinforcement walls according to the invention may be used in any orientation, including the horizontal where they may act as roofs or floors.

Optionally, one or both major faces of the wall is coated with passive fire protection. Naturally, when installed, if only one major face is so coated, it should be the face which is facing the expected fire hazard. The passive fire protection may be either fibrous type or intumescent type.

The invention will be further described and illustrated with reference to the accompanying drawings, in which.

For corrugated pressure resisting barriers it is an objective to maximise the efficiency of the profile by ensuring that all parts of the profile participate fully in resisting the bending moment applied (bending about the neutral axis X-X) when pressure is applied to the outside face of the wall (i.e. against the peaks of the corrugations).

Local buckling of plates in compression and/or shear can occur and when it does it reduces the effective width of the plate element in which the phenomenon occurs (Ref Eurocode 3 Part 1.1 or 1.3). That is, the resistance to the compression and/or shear forces is equivalent to that obtained with a narrower plate that is not buckling.

Figure 1:
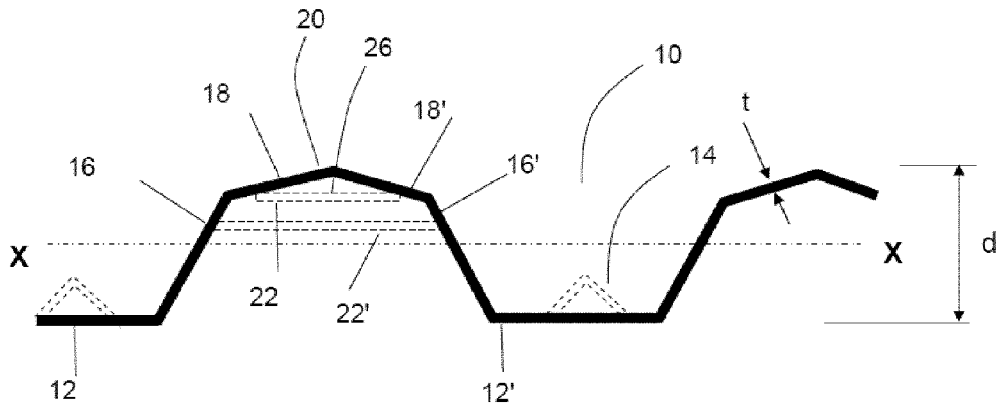
FIG. 1 shows a blast wall in transverse cross section, which wall is as described in GB2327098.

In FIG. 1, the corrugated wall member 10 of depth d comprises various plate elements. From opposed flange plate elements 12,12', there springs a four sided polygonal arch formed by plate elements 16,16' and 18,18'. The neutral axis is marked X-X. Plate elements 18 and 18' meet at a ridge 20. Two possible positions for a transverse plate stiffener 22 or 22' have been shown in dotted lines. Reinforcing Vee stiffeners 14 can be positioned over the flanges 12, 12'. The plate elements 18, 18', the parts of plate elements 16 and 16' above/outside the axis X-X and the compression stiffener 22 or 22' are all prone to local buckling and the extent to which they are prone is a function of the b/t (breadth/thickness) value for the element, the in-plane stress in it and Young's modulus of the material. In typical steel materials effectiveness is 100% up to a b/t value of about 30 for a plate in uniform compression but b/t is near 70 for the web element 16 or 16' which crosses the neutral axis and so has compression at one long edge and tension at the other (b being the breadth of the plate element 16 or 16').

For elements in shear (on its own) such as the web 16 or 16' the b/t value for 100% effectiveness is about 55.

The tension flange 12 is not affected by local buckling hence there are no restrictions on allowable b/t ratio, similarly for the vee stiffener 14. But if the profile is required to take reverse bending moment (pressure from below/inside in FIG. 1) the local buckling characteristics of the tension flange and tension flange stiffener become important and in the case of the tension flange stiffener in compression it has a stiffener buckling mode which reduces the effectiveness of the stiffener itself and the flange plating associated with it.

The compression flange stiffener 22 (upper position), can have a low width to thickness ratio by making it significantly narrower than the width of the chevron shaped compression flange 18,18', or else by making it significantly thicker than t, or a combination of both. Using different thickness materials in such a wall construction will generally involve some cost penalty however. For stiffener 22' to be at the lower position it has to be wider to reach all the way from one web to the other but being nearer the neutral axis X-X it has less stress in it so it can tolerate a b/t ratio which is larger than for stiffener 22 positioned at the upper position. However the stiffener 22' is quite close to the neutral axis so that it does not contribute a lot of resistance to bending moment. It does however support the web at a critical location in its compression zone, allowing the web to be deeper overall and therefore increasing the allowable value of d in FIG. 1. Alternatively it allows more shear stress or longitudinal bending stress or strain to be taken by the web due to the flange 22' acting as a longitudinal web stiffener.

For maximum efficiency (weight and material use) the profile should be as deep as possible (d as large as possible) and t as small as possible which conflicts with the requirements to ensure full effectiveness of all plate elements.

But there is an additional consideration for corrugated pressure resisting barriers and that is the local out-of-plane bending strength of each element and how weakness in this respect might act together with the longitudinal stresses and strains in overall bending and allow the section to become flattened and hence weakened in areas of high longitudinal bending strain. The longitudinal bending of the profile results in a longitudinal curvature of the profile which results in a second-order crushing effect which tends to push the both the compression and tension parts towards the neutral axis, buckling the webs. For the compression flanges these crushing pressures are additive to the applied external pressure but for the tension flanges they act in opposite directions so that crushing pressures tend to improve resistance and only dominate the tension flanges at high levels of strain in longitudinal bending.

Clearly the arched nature of the profile is better than a simple trapezoidal profile in this respect but at very high local pressures and longitudinal bending strains these effects dominate and measures to improve the out of plane pressure resistance of the plate elements will improve the profile's overall pressure-resisting performance. Arching the flange is one improvement compared to a conventional profile as it makes it stronger for such resistance and at the same time makes the web panel b/t ratio less. When the stiffener is in position 22' it supports the web increasing its out of plane pressure resistance and increasing its buckling resistance to transverse compression. It also gives a hollow box effect to the compression parts which has torsional strength to prevent the formation of asymmetric buckling modes of the whole cross section in the mid-span region where longitudinal bending stresses and strains are largest.

Figure 2:
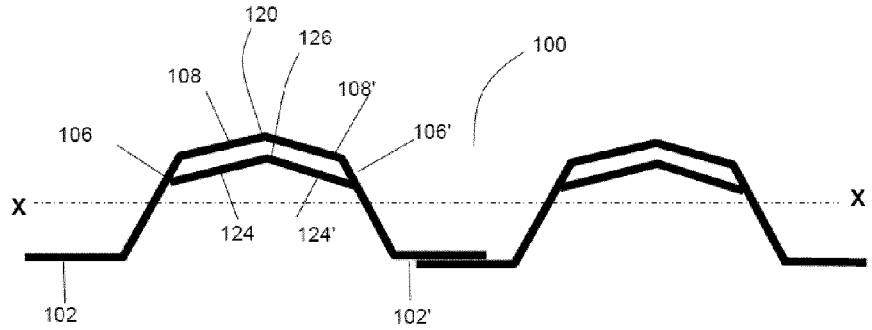
FIG. 2 shows a blast wall according to a first embodiment of the present invention in transverse cross section.
Figure 3:
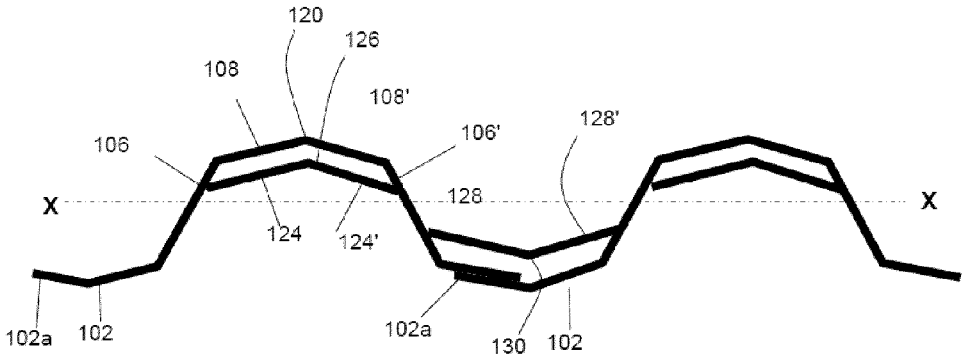
FIG. 3 shows a second embodiment of a pressure resisting wall according to the invention in transverse cross section.

The improvements shown in FIGS. 2 and 3 are designed to increase the efficiency of the profile, by improving section effectiveness and bending strength for a given amount of construction material.

The profile shown in FIG. 2 is that of a corrugated wall member 100 of depth d which comprises various plate elements. From opposed flange plate elements 102,102', there springs a four sided polygonal arch formed by plate elements 106,106' and 108,108'. The neutral axis of the wall is marked X-X. Plate elements 108 and 108' meet at a ridge 120. An internal reinforcement is provided by two plate elements 124,124' which extend upwardly/outwardly from symmetrically disposed levels on the plate elements 106 and 106' running approximately parallel with plate elements 108 and 108' to meet at a ridge 126. The level from which the plate elements 124, 124' spring from the plate elements 108, 108' is on the compression side (above in the drawings) of the neutral axis.

The change from flat stiffener 22 or 22' to chevron stiffener 124,124' overcomes the following problems:

1) the b/t value for the stiffener is virtually halved by dividing it into two plate elements;
2) its centroid is moved out away from the neutral axis increasing its contribution to bending resistance of the stiffened profile;
3) it supports the plates 106,106' in the compression zone so that b for these plates is reduced for a given profile depth d.
4) though it is not itself normally subject to out of plane pressure loads the chevron stiffener 124,124' is subject to second order crushing force towards the neutral axis and resistance to this is improved by the arch shape, the lateral component of force being resisted by bending of plates 106,106' and the out of plane pressure acting on the these plates, so that the plates can be thinner. The chevron stiffener 124,124' does not necessarily have to run the full length of the profile as the bending moments in the profile are typically less near its ends.

Having extra resistance on the compression side of the profile would move the neutral axis upwards and this is best balanced by having some extra tension flange material and this is easy to do by increasing the overlap between flanges 102 and 102' of successive corrugations.

The tension flange thickness within the overlap region is double and its out of plane bending strength is increased by a factor of four so that the allowable width of the flange can be increased despite the out of plane pressure and internal crushing force applied to it.

The combined effect of the above changes is to minimise individual plate panel b/t ratios and to allow a deeper profile section depth d for a given plate thickness and an increase of weight efficiency and reduction in cost. Alternatively by maintaining the same profile depth the out of plane pressure resistance and crushing resistance is increased. Increasing the crushing resistance allows more extreme fibre strain in bending and therefore more ductile deflection capacity.

FIG. 3 shows an embodiment of a pressure resisting wall adapted to resist pressure from either face, being largely symmetric about the neutral axis. The arrangement is similar to that shown in FIG. 2, but with the following alterations. The flange 102 is angled downwardly and extended by an upwardly angled subsidiary flange 102*a*. The joining of flanges 102' and 102*a* of successive corrugations produces a new chevron shape oppositely directed to that formed by plate elements 108 and 108'. Additional reinforcement plate elements 128 and 128' are provided springing from the upper faces of plate elements 106 and 106' of successive corrugations and extending generally parallel to flanges 102 and 102*a* so as to meet at a ridge or apex 130 directed oppositely to ridge 126. The level at which the plate elements 128, 128' leave the plate elements 106, 106' is on the tension side (below in the drawings) of the neutral axis.

By having the arches on both sides the possibility of having equal pressure resistance from both sides is obtained. This could be useful in situations where a wall separates two areas both of which have potential for equal levels of explosion load. But more especially the barrier could be a bulkhead separating two tanks containing liquid, such as a bulkhead in a ship's hull. Such bulkheads typically have to have virtually equal design pressures both sides.

The advantages of this FIG. 3 arrangement are similar to those of FIG. 2, but in this case the web panel width b is further reduced compared to overall section depth d, allowing the use of deeper profiles and therefore thinner profiles for the same bending resistance.

Whilst in both FIGS. 2 and 3, the internal reinforcement has been shown as a two sided, chevron shaped arch, alternative conformations are possible including polygonal arches with more sides or even a curved arch shape. Thus, FIG. 4 shows an embodiment in which the arch is three sided and FIG. 5 shows an embodiment in which the chevron stiffener 124,124' is replaced by a curved plate 125.

Figure 4:
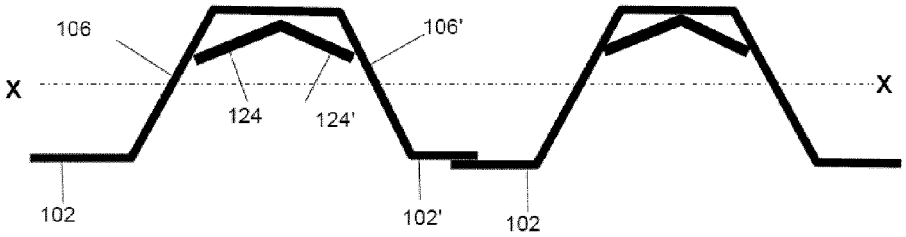
FIG. 4 shows a third embodiment of a pressure resisting wall according to the invention in transverse cross section.
Figure 5:
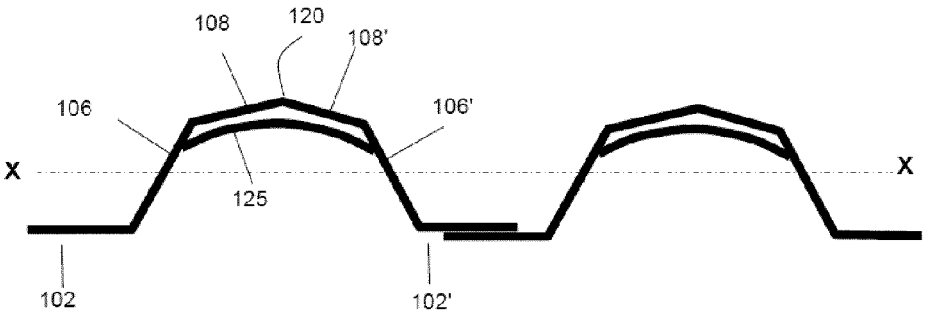
FIG. 5 shows a fourth embodiment of a pressure resisting wall according to the invention in transverse cross section.

A particular advantage of the embodiment shown in FIG. 4 is that it offers a way of providing a means of strengthening an already constructed corrugated wall having a trapezoidal profile. If such a wall were for instance on an offshore oil producing platform, then the all the fitting of the reinforcement wall would take place on the side of the wall not exposed to the explosion hazard, reducing the amount of work to be done under the cover of a hot work permit.

Figure 6:
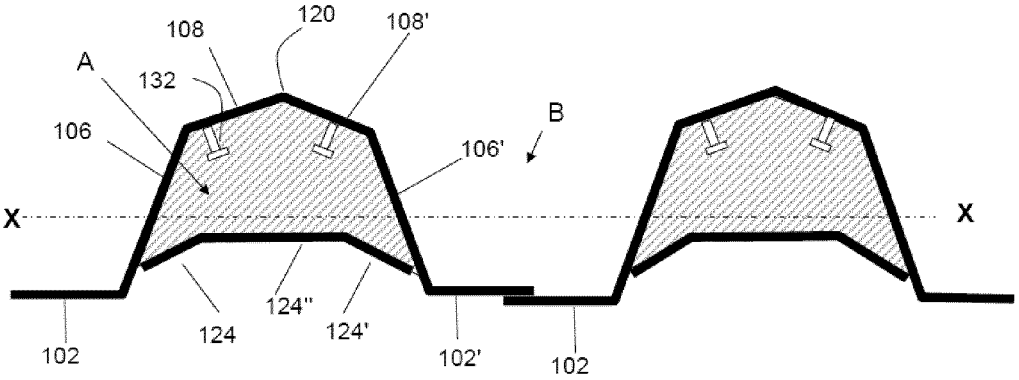
FIG. 6 shows a fifth embodiment of a pressure resisting wall according to the invention in transverse cross section.

Whereas in all of FIGS. 2-5, the centre of area of the reinforcement lies above (on the compression side) of the neutral axis, it is possible for part or all of the stiffener to lie on the tension side of the neutral axis as illustrated in FIG. 6.

The arrangement shown in FIG. 6 shows the chevron stiffener as being replaced by a 3 sided polygon with flat panels 124, 124' and 124" and is located on the tension side of the neutral axis. The space "A" in the corrugation above the reinforcement may be filled with concrete or cement grout to augment the compression resistance of the parts of the profile on compression side of the neutral axis. Alternatively the concrete may be applied into the trough space "B".

One advantage of this embodiment is that the concrete provides an inexpensive source of compression resistance and by acting compositely with the stiffened profile it adds to compression resistance and the reinforcement to tension resistance. The containment of the concrete by the plate elements helps increase composite action and the composite action could be further augmented by shear connectors or studs 132.

A second advantage of such an arrangement would be conferred if it were applied to an explosion resisting roof or wall to a control building on a chemical plant. Such buildings have sometimes to be designed to withstand explosion overpressures of short duration, e.g. 80 msec and in such circumstances the added mass of the concrete or grout will slow down and reduce the dynamic load factor for the response to impulsive loading so that the design equivalent static resistance of the roof and building may be reduced.

A third advantage is that such roofs are required to resist shear loads and the shear resistance of the arch profile will help.

A typical dimensioning of the stiffener 124, 124", 124' would be such as to produce a height to width ratio of 0.1:1 to 0.2:1. Generally, for all of the embodiments of the invention it is preferred that the height to width ratio of the curved or polygonal arched reinforcement walls is at least 0.1:1 and may be within the range of 0.1:1 to 0.2:1.

The joins between plate elements will generally be made by welding, although the joins between the overlapping flanges 102 and 102' or 102' and 102*a* might be made by through bolting or the like.

Preferred materials for the walls according to the invention include steel, preferably stainless steel, aluminium or non-metallic structural materials such as fibre reinforced plastics, e.g. GRP or Kevlar reinforced plastics or carbon reinforced plastics.

Examples of possible dimensions for walls according to all embodiments of the invention are depth d 200 to 500 mm, t in the range 2 to 12 mm and pitch between successive corrugations 300 to 1200 mm.

Figure 7:
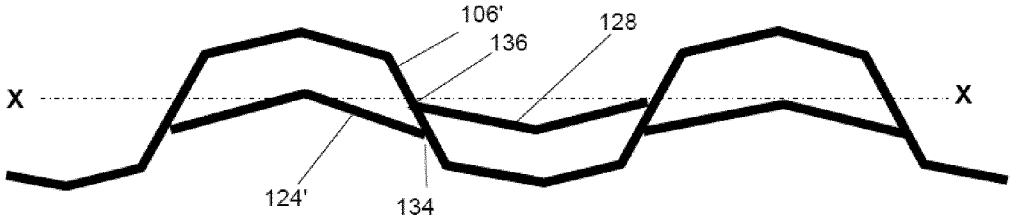
FIG. 7 shows a sixth embodiment, again in transverse cross section.

In any of these embodiments, a further reinforcement in the form of a polygonal or curved arch may be provided facing towards the tension side of the arch and reinforcing the base part of the corrugation, as in FIG. 3. It may be arranged that junctions between the sides of a reinforcement wall which is directed towards the compression side of the wall and its respective polygonal arch are so disposed with respect to junctions between sides of the adjacent reinforcement wall directed towards the tension side of the wall and the spaced polygonal arches of adjacent corrugations that to pass from one side of the cross section to the other involves passing through at least two plates. This is achieved if as shown in FIG. 7, the junction 134 between a side 124' of a reinforcement wall arched towards the compression side and the polygonal arch wall 106' lies in the tension side direction with respect to the junction 136 between a side 128 of an adjacent reinforcement wall arched towards the tension side and the said wall 106'.

In this specification, unless expressly otherwise indicated, the word 'or' is used in the sense of an operator that returns a true value when either or both of the stated conditions is met, as opposed to the operator 'exclusive or' which requires that only one of the conditions is met. The word 'comprising' is used in the sense of 'including' rather than in to mean 'consisting of'. All prior teachings acknowledged above are hereby incorporated by reference. No acknowledgement of any prior published document herein should be taken to be an admission or representation that the teaching thereof was common general knowledge in Australia or elsewhere at the date hereof.

The invention claimed is:

1. A pressure resisting barrier wall for use as a blast resisting wall, comprising a corrugated wall member having a series of side by side corrugations which viewed in transverse section each comprise spaced first and second base portions connected by a polygonal arch having at least four sides, and having within said arch a curved or polygonal arch reinforcement wall springing from side portions of said polygonal arch, the second base portion of a said corrugation being joined to the first base portion of a next corrugation in said series, wherein the blast resisting wall resists an overpressure blast of at least 0.14 bar.

2. A wall as claimed in claim 1, wherein the center of area of the reinforcement wall lies on the compression side of a neutral axis of the wall.

3. A wall as claimed in claim 2, wherein said reinforcement wall connects to the polygonal arch at a level which lies on the compression side of the neutral axis.

4. A wall as claimed in claim 1, wherein said polygonal arch is a four sided arch.

5. A wall as claimed in claim 1, wherein said reinforcement wall is a two sided polygonal arch.

6. A wall as claimed in claim 1, wherein the base of each corrugation comprises a flange which is overlapped with a corresponding flange of the base of an adjacent corrugation and fixed thereto.

7. A wall as claimed in claim 6, wherein said flanges are each overlapped by at least 60% of their width.

8. A wall as claimed in claim 1, wherein the ratio of the depth of each polygonal arch to its breadth is from 1:1.25 to 1:4.

9. A wall as claimed in claim 1, wherein said first and second base portions are so angled that the joining of the second base portion of a said corrugation to the first base portion of a next corrugation in said series produces a further and oppositely directed polygonal arch.

10. A wall as claimed in claim 1, wherein one or both major faces of the wall is coated with passive fire protection.

11. A pressure resisting barrier wall for use as a blast resisting wall or as a load retaining wall, comprising a corrugated wall member having a series of side by side corrugations which viewed in transverse section each comprise spaced first and second base portions connected by a polygonal arch having at least four sides, and having within said arch a curved or polygonal arch reinforcement wall springing from side portions of said polygonal arch, the second base portion of a said corrugation being joined to the first base portion of a next corrugation in said series, wherein junctions between a first reinforcement wall and its respective polygonal arch are so disposed with respect to junctions between an adjacent second reinforcement wall and its respective polygonal arch that to pass from one side of the pressure resisting barrier wall to the opposite side thereof involves passing through at least two thicknesses of wall material, wherein the first reinforcement wall faces a compression side of the pressure resisting barrier wall, and wherein the second reinforcement wall faces a tension side of the pressure resisting barrier wall.

12. A pressure resisting barrier wall for use as a blast resisting wall or as a load retaining wall, comprising a corrugated wall member having a series of side by side corrugations which viewed in transverse section each comprise spaced first and second base portions connected by a polygonal arch having at least four sides, and having within said arch a curved or polygonal arch reinforcement wall springing from side portions of said polygonal arch, the second base portion of a said corrugation being joined to the first base portion of a next corrugation in said series, wherein a first reinforcement wall forms a first junction pair with side portions of a first polygonal arch and an adjacent second reinforcement wall forms a second junction pair with side portions of a second polygonal arch such that to pass from one side of the pressure resisting barrier wall to an opposite side thereof requires passing through at least two thicknesses of wall material, wherein the first reinforcement wall faces towards a compression side of the pressure resisting barrier wall and the second reinforcement wall faces towards a tension side of the pressure resisting barrier wall.

13. A wall as claimed in claim 12, wherein the first junction pair and the second junction pair are vertically offset from a neutral axis of the wall when viewed in transverse section.

* * * * *